US008766611B2

(12) United States Patent
Hu et al.

(10) Patent No.: US 8,766,611 B2
(45) Date of Patent: Jul. 1, 2014

(54) REFERENCE VOLTAGE GENERATION CIRCUIT AND METHOD

(75) Inventors: Min-Hung Hu, Hsinchu (TW); Chen-Tsung Wu, Kaohsiung (TW); Zhen-Guo Ding, Tainan (TW); Pin-Han Su, Taichung (TW)

(73) Assignee: Novatek Microelectronics Corp., Hsinchu (TW)

( * ) Notice: Subject to any disclaimer, the term of this patent is extended or adjusted under 35 U.S.C. 154(b) by 508 days.

(21) Appl. No.: 13/205,324

(22) Filed: Aug. 8, 2011

(65) Prior Publication Data

US 2012/0126616 A1 May 24, 2012

(30) Foreign Application Priority Data

Nov. 19, 2010 (TW) ..... 99140101 A

(51) Int. Cl.
*G05F 3/26* (2006.01)
*G05F 1/577* (2006.01)

(52) U.S. Cl.
USPC ..... 323/281; 323/314; 323/315; 323/907

(58) Field of Classification Search
USPC ..... 323/267, 273, 281, 311, 313, 314, 315, 323/907
See application file for complete search history.

(56) References Cited

U.S. PATENT DOCUMENTS 6,774,666 B1 * 8/2004 Samad ..... 326/32
7,276,885 B1 * 10/2007 Tagare ..... 323/267
8,405,376 B2 * 3/2013 Hwang et al. ..... 323/314

* cited by examiner

*Primary Examiner* — Gary L Laxton
(74) *Attorney, Agent, or Firm* — Rabin & Berdo, P.C.

(57) ABSTRACT

A reference voltage generation circuit includes: a bandgap reference circuit, generating a plurality of initial currents with different temperature coefficients; a base voltage generation circuit, combining the initial current into a combined current, and converting the combined current into one or more base voltages; a bias current source circuit, generating one or more bias currents based on at least one of the initial currents; and one or more regulating output circuit, each converting a respective one of the one or more bias currents into an increment voltage and adding the increment voltage to the base voltage to generate a respective output voltage. Each output voltage may have its respective temperature coefficient.

21 Claims, 7 Drawing Sheets

REFERENCE VOLTAGE GENERATION CIRCUIT AND METHOD

This application claims the benefit of Taiwan application Serial No. 99140101, filed Nov. 19, 2010, the subject matter of which is incorporated herein by reference.

TECHNICAL FIELD

The disclosure relates in general to a reference voltage generation circuit and method, and more particularly to a reference voltage generation circuit and method using a bandgap reference circuit.

BACKGROUND

Due to the characteristics of semiconductor, the output reference voltage of the reference voltage generation circuit has a temperature coefficient (abbreviated as TC) to compensate the temperature effect. For example, when an output reference voltage is 1.6V+10 mV/° C., the absolute voltage of the output reference voltage is 1.6V at specified temperature (ex: 25° C.), and the temperature coefficient is 10 mV/° C.

FIG. 1A shows output reference voltages having different absolute voltage values, wherein curves A1, B1 and C1 respectively indicate that the output reference voltage is 1.2V+10 mV/° C., 1.6V+10 mV/° C. and 2.0V+10 mV/° C. FIG. 1B shows output reference voltages having different temperature coefficients, wherein the curves A2, B2 and C2 respectively indicate that the output reference voltage is 1.6V+5 mV/° C., 1.6V+10 mV/° C. and 1.6V+15 mV/° C.

To adjust the absolute voltage value and the temperature coefficient, in a conventional reference voltage generation circuit, normally a bandgap circuit is used for generating a zero temperature coefficient voltage (zero-TC voltage) and a positive-TC voltage (positive-TC voltage), and an adder (or a subtractor) having buffers may be used for adding (or subtracting) the generated voltages to generate the output reference voltages with different temperature coefficients.

However, due to having the buffers, the conventional structure is too huge, and the power consumption and the circuit area are larger than other conventional circuits performing no temperature compensation. Besides, the buffers used in the addition/subtraction of voltages will incur extra offset, further severely affecting the accuracy in the output reference voltage and the temperature coefficient.

BRIEF SUMMARY

The disclosure provides a reference voltage generation circuit and method. Since currents with temperature coefficients, rather than voltages, are used for subsequent processing, there is no need to implement buffers, and many advantages such as small area, low power consumption, simple structure, and accurate temperature coefficient may thus be achieved in the disclosure.

The disclosure provides a reference voltage generation circuit and method. The currents are combined into a bias current through current subtraction, so that the temperature coefficient of the bias current may be increased. Thus, the output reference voltage in the required range may be achieved by a small variable resistor, and the base voltage having a zero temperature coefficient may have a widened input range.

The disclosure provides a reference voltage generation circuit and method. Through switching between current paths, the bias current having different temperature coefficients may be switched, so that the output reference voltage may be switched different temperature coefficients. The disclosure is used in various occasions to achieve wider and more flexible applications.

According to an exemplary embodiment of the disclosure, a reference voltage generation circuit includes: a bandgap reference circuit for generating a plurality of initial currents with different temperature coefficients; a base voltage generation circuit coupled to the bandgap reference circuit for duplicating and combining the initial currents into a combined current, and for converting the combined current into one or more base voltages; a bias current source circuit coupled to at least one of the bandgap reference circuit and the base voltage generation circuit for generating one or more bias currents according to at least one of the initial currents; and one or more regulating output circuits, each coupled to the base voltage generation circuit for receiving a corresponding one of the one or more base voltages and coupled to the bias current source circuit for receiving a corresponding one of the one or more bias currents and converting the received bias current into a respective increment voltage and adding the increment voltage to the base voltage to generate a respective output reference voltage.

According to an alternative exemplary embodiment of the disclosure, a reference voltage generation method is provided. The method includes: generating a plurality of initial currents with different temperature coefficients; duplicating the initial and combining the currents into a combined current and converting the combined current into one or more base voltages; generating one or more bias currents according to at least one of the initial currents; and converting the one or more bias currents into one or more increment voltages and adding the one or more increment voltages to one of the base voltages to generate one of one or more output reference voltages.

It is to be understood that both the foregoing general description and the following detailed description are exemplary and explanatory only and are not restrictive of the disclosed embodiments, as claimed.

DETAILED DESCRIPTION OF THE DISCLOSURE

In a reference voltage generation circuit disclosed in the disclosure, initial currents with different temperature coefficients (such as a positive temperature coefficient current and a negative temperature coefficient current) are summed to generate a combined current and converted into a base voltage, and one or more bias currents are generated according to the initial currents. One or more output reference voltages with positive/negative/zero temperature coefficients are generated according to the bias currents and the base voltage. A number of embodiments are disclosed below for elaboration.

First Embodiment

Figure 1A:
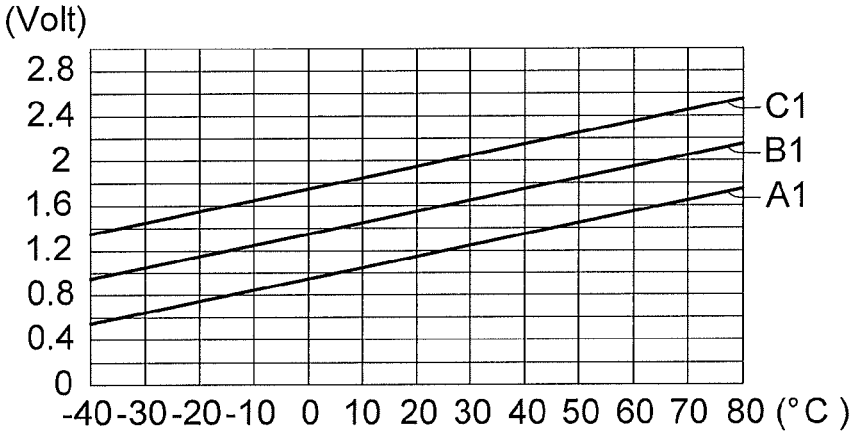
FIG. 1A (Prior Art)
FIG. 1A shows output reference voltages having different absolute voltage values but having the same temperature coefficient.
Figure 1B:
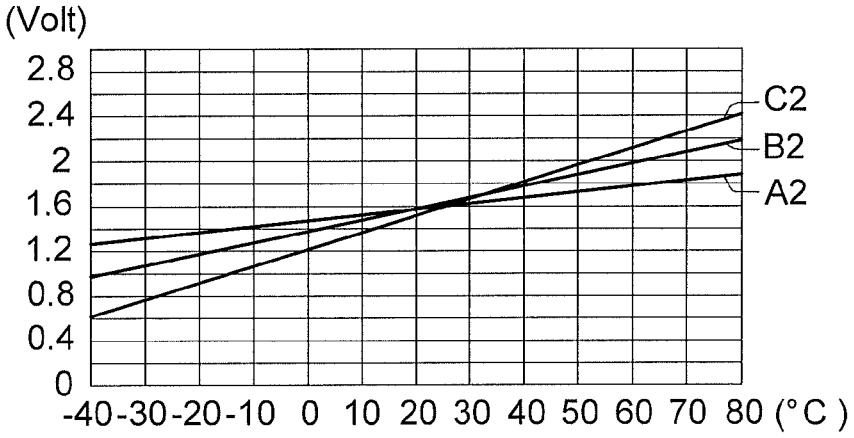
FIG. 1B (Prior Art)
FIG. 1B shows output reference voltages having different temperature coefficients but having the same absolute voltage at 25° C.
Figure 2:
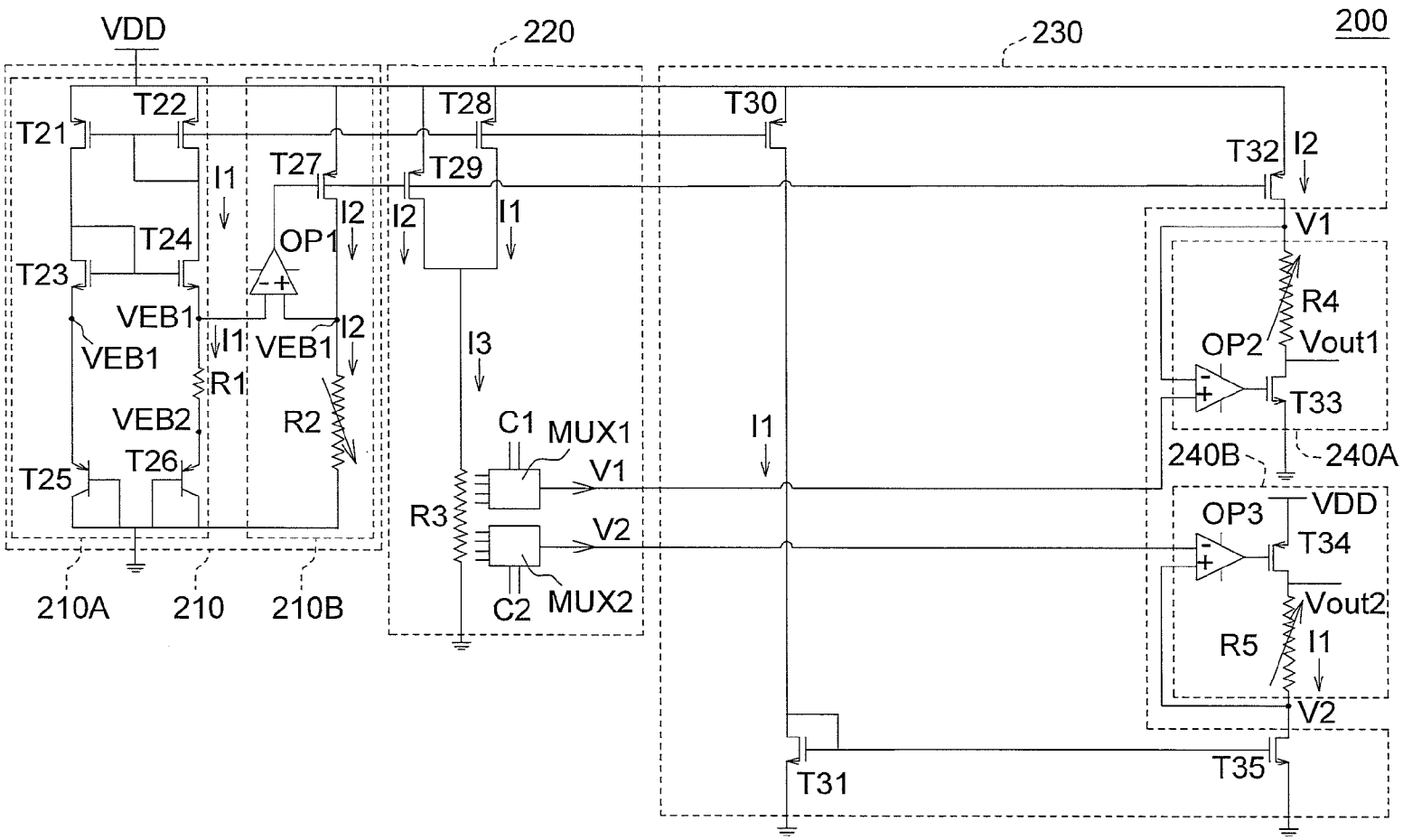
FIG. 2 shows a schematic diagram of a reference voltage generation circuit according to a first embodiment of the disclosure.

Referring to FIG. 2, a schematic diagram of a reference voltage generation circuit according to a first embodiment of the disclosure is shown. As indicated in FIG. 2, the reference voltage generation circuit 200 includes a bandgap reference circuit 210, a base voltage generation circuit 220, a bias current source circuit 230 and one or more regulating output circuits (exemplified by two regulating output circuits 240A and 240B). The following elaboration is also applicable to fewer or more regulating output circuits.

The bandgap reference circuit 210 may be used for generating initial currents with different temperature coefficients. Under exemplary conditions, the initial currents include a first current I1 with a positive temperature coefficient and a second current I2 with a negative temperature coefficient.

The base voltage generation circuit 220 is coupled to the bandgap reference circuit 210, for duplicating the initial currents generated by the bandgap reference circuit 210, combining the duplicated initial currents into a combined current, and converting the combined current into one or more base voltages. In the exemplary embodiment of FIG. 2, the base voltage generation circuit 220 duplicates the first current I1 and the second current I2 and combines the duplicated first current I1 and the duplicated second current I2 into a third current I3 with a zero temperature coefficient, and converting the third current I3 into the base voltages V1 and V2 with zero temperature coefficients.

The bias current source circuit 230 is coupled to at least one of the bandgap reference circuit 210 and the base voltage generation circuit 220. The bias current source circuit 230 generates one or more bias currents according to at least one of the first current I1 and the second current I2. As indicated in FIG. 2, two bias currents being the first and the second currents I1 and I2 are take as an example.

The regulating output circuits 240A and 240B are both coupled to the base voltage generation circuit 220 for receiving the base voltages V1 and V2 respectively. Besides, the regulating output circuits 240A and 240B are coupled to the bias current source circuit 230 for receiving bias currents (exemplified by receiving the second current I2 and the first current I1). The regulating output circuits 240A and 240B convert the received bias currents into respective increment voltages (that is, voltages across the resistors R4 and R5) and add the respective increment voltages to the base voltages V1 and V2 to generate output reference voltages Vout1 and Vout2.

FIG. 2 shows detailed circuit structures of the bandgap reference circuit 210, the base voltage generation circuit 220, the bias current source circuit 230 and the regulating output circuits 240A and 240B. It is noted that the detailed structures of FIG. 2 are for elaboration purpose only, and other circuit structures may be used for implementing the bandgap reference circuit 210, the base voltage generation circuit 220, the bias current source circuit 230 and the regulating output circuits 240A and 240B as long as the above functions are achieved.

In the exemplary example of FIG. 2, the bandgap reference circuit 210 includes a proportional to absolute temperature (PTAT) current generation circuit 210A for generating the first current I1 with a positive temperature coefficient, and a voltage-to-current conversion circuit 210B coupled to a node of the PTAT current generation circuit 210A for converting the voltage VEB1 of the node into the second current I2 with a negative temperature coefficient. By the voltage-to-current circuit which converts the negative-TC voltage (such as the node voltage VEB1) into the second current I2 with the negative temperature coefficient, the embodiment of the disclosure has advantages of few elements and small circuit area.

In the present example, the PTAT current generation circuit 210A includes a pair of junction transistors T25 and T26 such as PNP bipolar junction transistors (BJT), whose collectors and bases are both coupled to a reference voltage such as a ground GND. The junction transistors T25 and T26 have different current densities. For example, the junction transistor T25 has an area A smaller than the area nA of the junction transistor T26, wherein n is a positive integer larger than 1. Further, the PTAT current generation circuit 210A further has a pair of field-effect transistors T23 and T24 such as N-type metal oxide semiconductors (NMOS), whose gates are connected and drains thereof are respectively coupled to the emitters of the junction transistors T25 and T26. The gate and the source of the field-effect transistors T23 are connected. Besides, the PTAT current generation circuit 210A further includes another pair of field-effect transistors T21 and T22, such as P-type metal oxide semiconductors (PMOS), whose gates are connected, sources are both coupled to another reference voltage (such as VDD), and drains are respectively coupled to the drain of the field-effect transistors T23 and T24. With the field-effect transistors T21~T24, the source voltages of the field-effect transistors T23 and T24 are identical to each other and equal to the base-emitter voltage VEB1 of the junction transistors T25. Thus, the voltage V1 across the first resistor R1 can be expressed as: VEB1−VEB2=KTIn (n). That is, the first current I1 flowing through the first resistor element R1 is equal to KTIn (n)/R1. In other words, the temperature coefficient of the first current I1 is positive.

The voltage-to-current conversion circuit 210B of FIG. 2 further includes an operational amplifier OP1 and a resistor R2. Two input ends of the operational amplifier OP1 may be locked at the same voltage (that is, the node voltage VEB1 of the PTAT current generation circuit 210A) due to virtual short. Via the resistor R2, the node voltage VEB1 is converted into the second current I2 expressed as: I2=VEB1/R2. Since the node voltage VEB1 is a negative-TC voltage, the temperature coefficient of the second current I2 is negative. Besides, the voltage-to-current conversion circuit 210B includes a field-effect transistor T27, with a gate voltage reflecting the magnitude of the second current I2.

The base voltage generation circuit 220 of FIG. 2 further includes a mirror circuit having first and second mirror transistors T28 and T29 whose gates are coupled to the bandgap reference circuit 210 for duplicating the first current I1 and the second current I2 respectively. Besides, the base voltage generation circuit 220 further includes a resistor R3 coupled to the sources of the first mirror transistors T28 and the second mirror transistors T29, for summing the first current I1 and the second current I2 into a third current I3 and further converting the third current I3 into one or more base voltages (such as V1 and V2) due to the resistor characteristic. Alternatively, the third resistor R3 may be a variable resistor. For example, with one or more multiplexers (such as multiplexers MUX1 and MUX2) respectively coupled to the resistor R3, the control signals C1 and C2 may be used for selecting the resistance of the resistor R3 and adjusting the base voltages V1 and V2. In the above exemplification, the single resistor R3 is disposed in the base voltage generation circuit 220. In practical applications, more than one resistors may be disposed for obtaining more than one base voltages.

Figure 3:
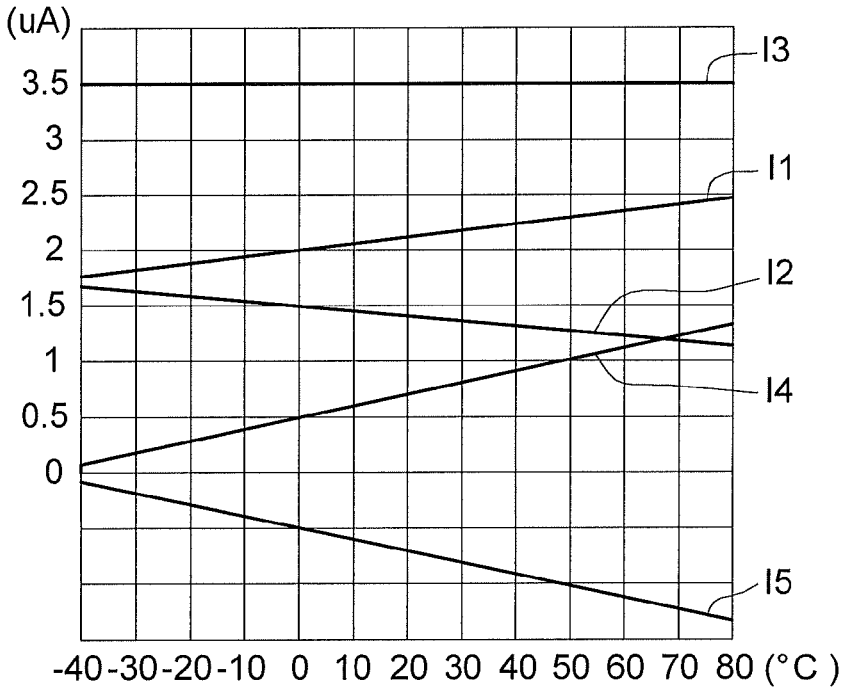
FIG. 3 shows currents having different temperature coefficients.

FIG. 3 shows a temperature schematic diagram of the first to third currents I1~I3. Under exemplary conditions, the sum of the first current and the second current, i.e. the third current I3 flowing through the resistor R3, may have a zero temperature coefficient through appropriate circuit design. Suppose the temperature coefficient of the first current I1 is (+10 μA/° C.) and the temperature coefficient of the second current I2 is (−10 μA/° C.), then the temperature coefficient of the third current I3 may be expressed as: +10 μA/° C.+(−10 μA/° C.)=0 μA/° C. Since the third current I3 has a zero temperature coefficient, the voltage across the resistor R3 is a zero-TC voltage. Under the control of the control signals C1 and C2, the multiplexers MUX1 and MUX2 output the base voltages V1 and V2, which are zero-TC voltages, from the resistor R3.

Referring to FIG. 2. The bias current source circuit 230 of FIG. 2 includes mirror transistors T30~T32 and T35. The transistor T30, T31 and T35, through connection between their gates, may duplicate the first current I1 with the positive temperature coefficient by mirroring the currents of the transistors T21, T22 and T28. Likewise, through connection of the gates, the transistor T32 may duplicate the second current I2 with the negative temperature coefficient by mirroring the currents of the transistors T27 and T32.

In the exemplary detailed structure of FIG. 2, two regulating output circuits 240A and 240B are exemplified for elaboration purpose. In the present example, the regulating output circuits 240A and 240B may be realized by class A regulating output circuits. In more details, the regulating output circuits 240A includes a resistor element (such as the variable resistor R4) having a first end coupled to the output node Vout1 and a second end receiving the second current I2 duplicated by the mirror transistor T32. Besides, the regulating output circuits 240A further includes: an output transistor T33 coupled between the output node Vout1 and a reference level (such as ground GND); and an operational amplifier OP2 having a first input end receiving the base voltage V1, a second input end coupled to the variable resistor R4 and an output end coupled to the gate of the output transistor T33. Likewise, the regulating output circuit 240B includes a resistor element (such as the variable resistor R5), an output transistor T34, and an operational amplifier OP3. The connection of the regulating output circuits 240B is similar to that of the regulating output circuits 240A except that the variable resistor R5 receives the first current I1 duplicated by the mirror transistors T35, and the variable resistor R5 and the output transistor T34 are coupled to the output node Vout2.

In the regulating output circuits 240A, through virtual short of the operational amplifier OP2, the voltage at the second end of the variable resistor R4 is equal to the base voltages V1. Besides, an increment voltage (−I2*R4) across the variable resistor R4 is generated along with the current I2. Thus, the output reference voltage Vout1 is equal to the sum of the base voltages V1 and the increment voltage (−I2*R4), expressed as: Vout1=V1−I2*R4. Under exemplary conditions that the base voltages V1 has a zero temperature coefficient and the second current I2 has a negative temperature coefficient, the output reference voltage Vout1 has a positive TC and the temperature coefficient thereof may be adjusted through the variable resistor R4. Likewise, through the operational amplifier OP3 and the variable resistor R5, the output reference voltage Vout2 is equal to the sum of the base voltages V2 and the increment voltage I1*R5, expressed as: Vout2=V2+I1*R5. Under exemplary conditions that the base voltages V2 is a zero-TC voltage and the first current I1 is a current with a positive temperature coefficient, the output reference voltage Vout2 may be a positive-TC voltage and the temperature coefficient thereof is adjusted through the variable resistor R5.

To summarize, in the reference voltage generation circuit 200, the bandgap reference circuit 210 generates the first and the second currents I1 and I2 with different temperature coefficients; the base voltage generation circuit 220 mirrors currents and converts the currents to generate the base voltages with a zero temperature coefficient; the bias current source circuit 230 mirrors currents to duplicate one or more bias currents; and the regulating output circuits 240A and 240B convert the base voltage and one or more bias currents into one or more output reference voltages with different temperature coefficients.

In comparison to the convention art characterized by complicated structure and huge area, the reference voltage generation circuit 200 of the present embodiment does not need buffers in the addition or subtraction of the voltages from the bandgap reference circuit. Instead, the reference voltage generation circuit 200 of the present embodiment extracts the currents (referred as initial currents) generated by the bandgap reference circuit; and the bias current source circuit 230, the base voltage generation circuit 220 and the regulating output circuits 240A and 240B having smaller circuit areas and simpler structure may be used to generate one or more output reference voltages with different temperature coefficients. Accordingly, the reference voltage generation circuit 200 of the present embodiment has many advantages, such as small circuit area, low power consumption, simple structure, and accurate temperature coefficients.

In other embodiments, different current mirroring paths are possible, so that the current flowing through the variable resistor R4 may be the current I1 with a positive temperature coefficient, and the output reference voltage Vout1 may be a negative-TC voltage. Additionally, different current mirroring paths are possible, so that the current flowing through the variable resistor R5 may be the current I2 with a negative temperature coefficient, and the output reference voltage Vout2 may be a negative-TC voltage. In other words, the output reference voltages Vout1 and Vout2 may have positive and/or negative temperature coefficients, whose magnitudes may be adjusted through the variable resistors R4 and R5.

In other embodiments, more or fewer bias currents and regulating output circuits may be implemented for providing more or fewer output reference voltages with identical or different temperature coefficients. Furthermore, the combined current and the base voltage generated by the base voltage generation circuit 220 are not limited to having a zero temperature coefficient, and for example they may have a non-zero temperature coefficient. Thus, the technologies disclosed above have flexible and wide application.

Second Embodiment

Figure 4:
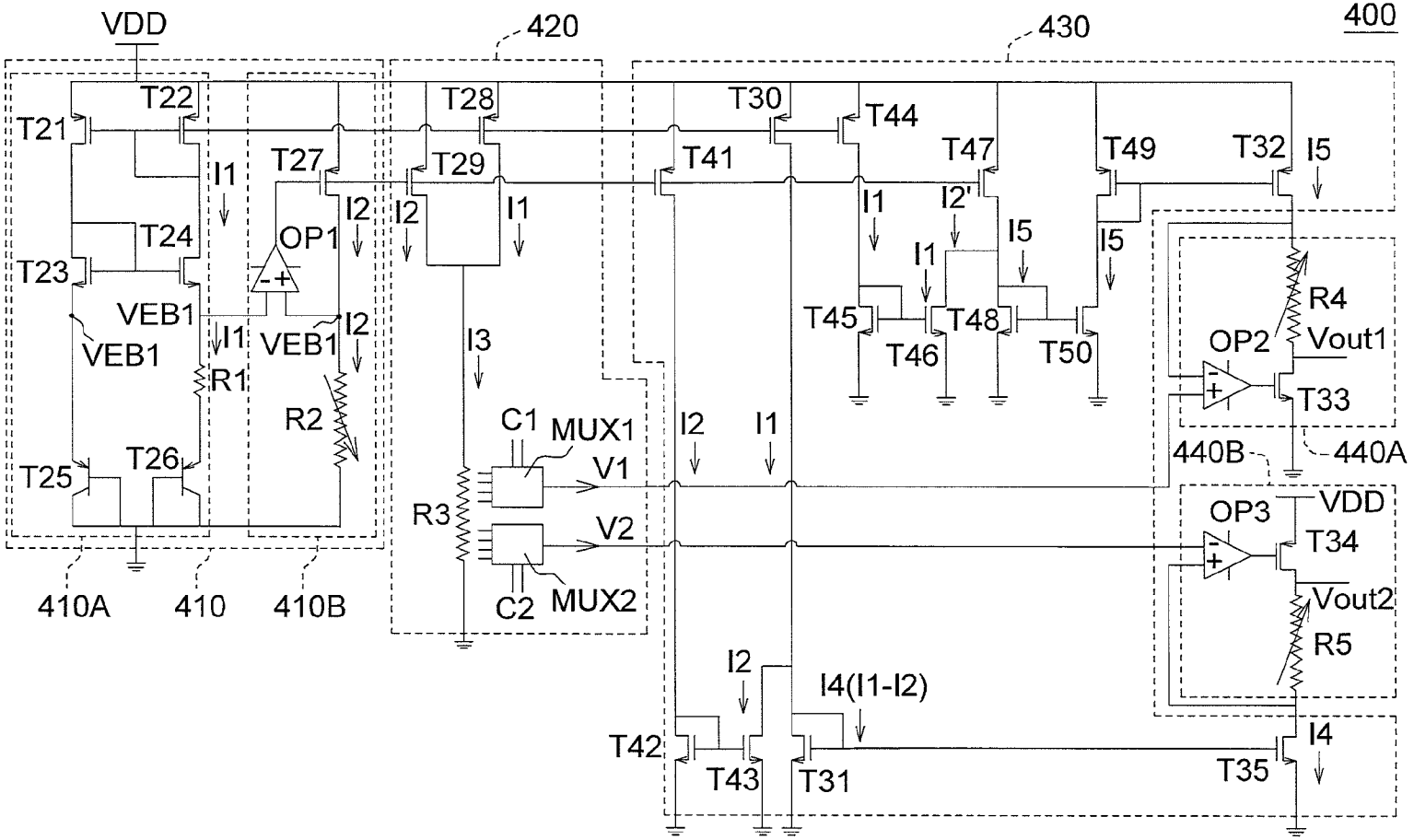
FIG. 4 shows a schematic diagram of a reference voltage generation circuit according to a second embodiment of the disclosure.

Referring to FIG. 4, a schematic diagram of a reference voltage generation circuit according to a second embodiment of the disclosure is shown. Similar to the reference voltage generation circuit 200 of FIG. 2, the reference voltage generation circuit 400 of FIG. 4 includes a bandgap reference circuit 410, a base voltage generation circuit 420, a bias current source circuit 430 and one or more regulating output circuits (exemplified by two regulating output circuits 440A and 440B).

In the exemplary example of FIG. 4, the bandgap reference circuit 410 further includes a PTAT current generation circuit 410A and a voltage-to-current conversion circuit 410B. The reference voltage generation circuit 400 of FIG. 4 is different from the reference voltage generation circuit 200 of FIG. 2 in that the bias current source circuit 430 not only duplicates the first and the second current I1 and I2 into bias currents but also has a current combining function to realize mathematical operation and provide the bias currents with different temperature coefficients, so that the regulating output circuits 440A and 440B may generate output reference voltages with different temperature coefficients. The differences between the reference voltage generation circuit 200 and the reference voltage generation circuit 400 are elaborated below, and the similarities disclosed in the first embodiment are not repeated here.

In the exemplary example of FIG. 4, the current combining function is exemplified by current subtraction, which may increase the temperature coefficient of the output reference voltage. To achieve the current subtraction, the bias current source circuit 430 includes mirror transistors T41~T50.

By mirroring the current of the transistor T27, the mirror transistors T41, T42 and T43 duplicate the second current I2 with a negative temperature coefficient. Like FIG. 2, the mirror transistor T30 duplicates the first current I1. Thus, the bias current I4 flowing through the mirror transistor T31 has a positive temperature coefficient, expressed as: I4=I1−I2. By mirroring the current of the mirror transistor T31, the mirror transistors T35 duplicates the bias current I4 for provision to the regulating output circuit 440B.

Likewise, by mirroring the currents of the transistor T21 and T22, the mirror transistors T44, T45 and T46 duplicate the first current I1 with a positive temperature coefficient. By mirroring the current of the transistor T27 and by appropriate design of dimensions of the transistors, the mirror transistors T41 and T47 may duplicate the current I2' with a negative temperature coefficient, the current I2' being a multiple of the second current I2. The relationship is expressed as: I2'>I1>I2. Thus, the bias current I5 flowing through the mirror transistor T48 is a current with a negative temperature coefficient and is expressed as: I5=I2'−I1. By mirroring the current of the mirror transistor T48, the mirror transistors T50, T49, T32 duplicate the bias current I5 for provision to the regulating output circuit 440A.

Referring to FIG. 3, the temperature coefficients of the bias currents I4 and I5 are shown. As indicated in FIG. 3, despite the fact that the currents I1 and I4 both are currents with positive temperature coefficients, the absolute value of the temperature coefficient of the current I4 is larger than the absolute value of the temperature coefficient of the bias current I1. Besides, despite the fact that the bias currents I2, I2' and I5 all are currents with negative temperature coefficients, the absolute value of the temperature coefficient of the bias current I5 is larger than the absolute value of the temperature coefficient of the second current I2. Supposing the temperature coefficient of the current I1 is +10 μA/° C. and the temperature coefficient of the current I2 is −10 μA/° C., then the temperature coefficient of the current I4 is +10 μA/° C.−(−10 μA/° C.)=+20 μA/° C., and the temperature coefficient of the current I5 is −10 μA/° C.−(+10 μA/° C.)=−20 μA/° C.

In the regulating output circuit 440A, the output reference voltage Vout1 is Vout1=V1-I5*R4. Under exemplary conditions that the base voltage V1 is a zero-TC voltage and the bias currents I5 is a current with a negative temperature coefficient, the output reference voltage Vout1 is a positive-TC voltage. Likewise, in the regulating output circuits 440B, the output reference voltage Vout2 is Vout2=V2+I4*R5. Under exemplary conditions that the base voltages V2 is a zero-TC voltage and the bias current I4 is a current with a positive temperature coefficient, the output reference voltage Vout2 is a positive-TC voltage. As indicated in the relevant disclosure of FIG. 3, since the absolute values of the temperature coefficients of the bias currents I4 and I5 are larger, the temperature coefficients of the output reference voltages Vout1 and Vout2 also increase accordingly.

To summarize, by generating the bias current I4 from (1) deducting the second current I2 with a negative temperature coefficient from the first current I1 with a positive temperature coefficient, or (2) deducting the first current I1 with a positive temperature coefficient from the current I2' with a negative temperature coefficient, the temperature coefficients of the bias currents I4 and I5 may be increased up to several times. The present embodiment has advantages. For example, the required ranges of the output reference voltages Vout2 and Vout1 may be achieved by small variable resistors R4 and R5, so that the circuit area may be reduced. Besides, the bias currents I4 and I5 obtained from the subtraction of currents are small, so that the voltage drop across the variable resistors R4 and R5 may be decreased, which may increase the input range of the base voltages V1 and V2 with zero temperature coefficients.

Like FIG. 2, in other embodiments, different current mirroring paths may be designed, so that the current flowing through the variable resistor R4 may be the current I4 with a positive temperature coefficient, and the output reference voltage Vout1 may be a negative-TC voltage. Additionally, different current mirroring paths may be designed, so that the current flowing through the variable resistor R5 may be the current I5 with a negative temperature coefficient, and the output reference voltage Vout2 may be a negative-TC voltage. In other words, the output reference voltages Vout1 and Vout2 have many combinations of positive and/or negative temperature coefficients whose magnitudes may be adjusted through the variable resistors R4 and R5.

In other embodiments, more or fewer bias currents and regulating output circuits may be implemented for providing more or fewer output reference voltages with identical or different temperature coefficients. Furthermore, the combined current and the base voltage generated by the base voltage generation circuit 420 are not limited to having zero temperature coefficients and may have non-zero temperature coefficients. Thus, the technologies disclosed above have flexible and wide application.

In the exemplary example of FIG. 4, the current combining function capable of increasing temperature coefficients of the output reference voltages is exemplified by current subtraction. However, in other embodiments, the bias current source circuit 430 may implement different types of current combination, such as summing or subtracting the first and the second currents I1 and I2 by different weights, to generate the output reference voltages with different temperature coefficients. Furthermore, given that the bandgap reference circuit 410 generates more initial currents, more types of current combination on the initial currents may be implemented to generate output reference voltages with different temperature coefficients. The technology disclosed here may achieve wide and flexible applications.

Third Embodiment

Figure 5A:
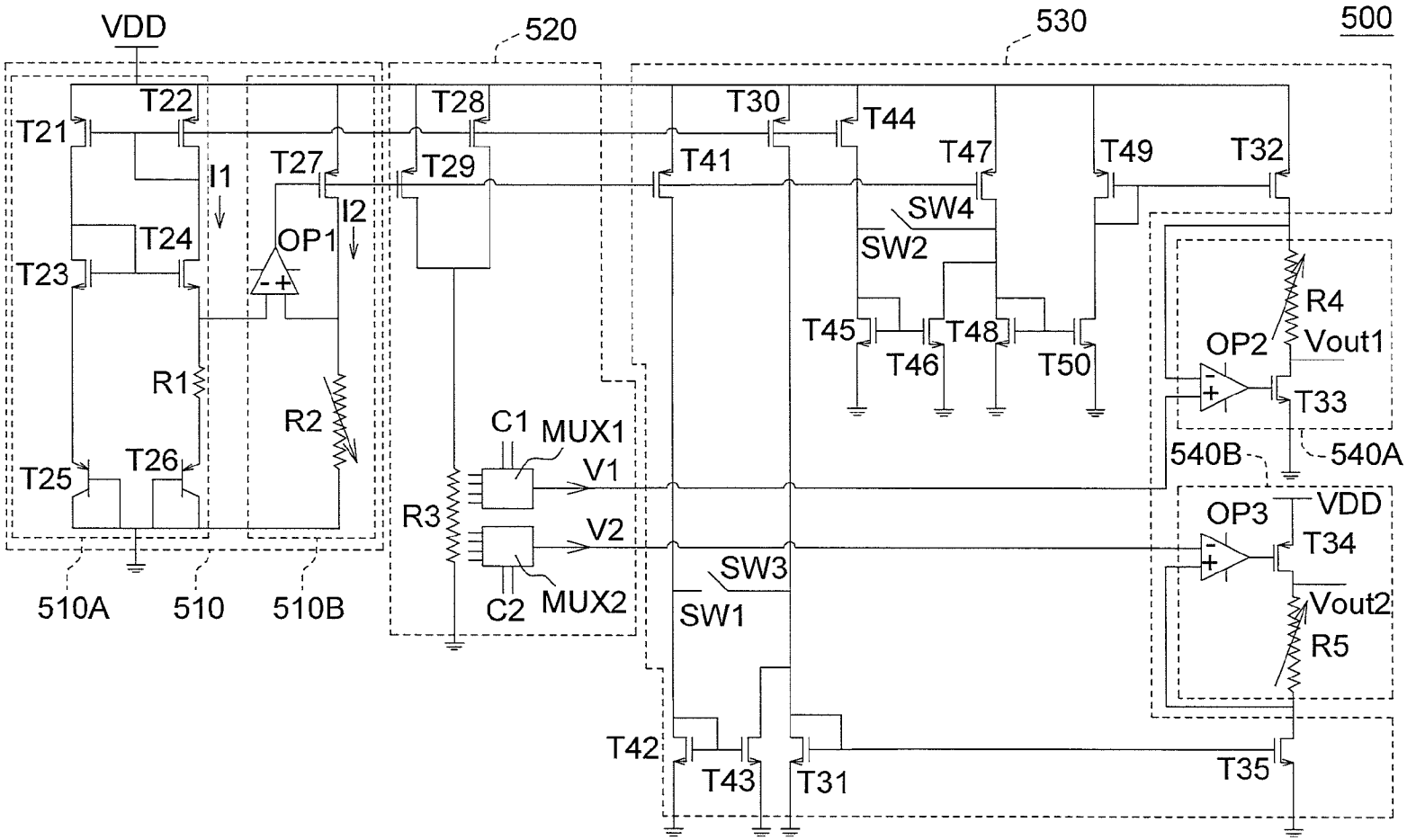
FIGS. 5A and 5B show a reference voltage generation circuit according to a third embodiment of the disclosure.
Figure 5B:
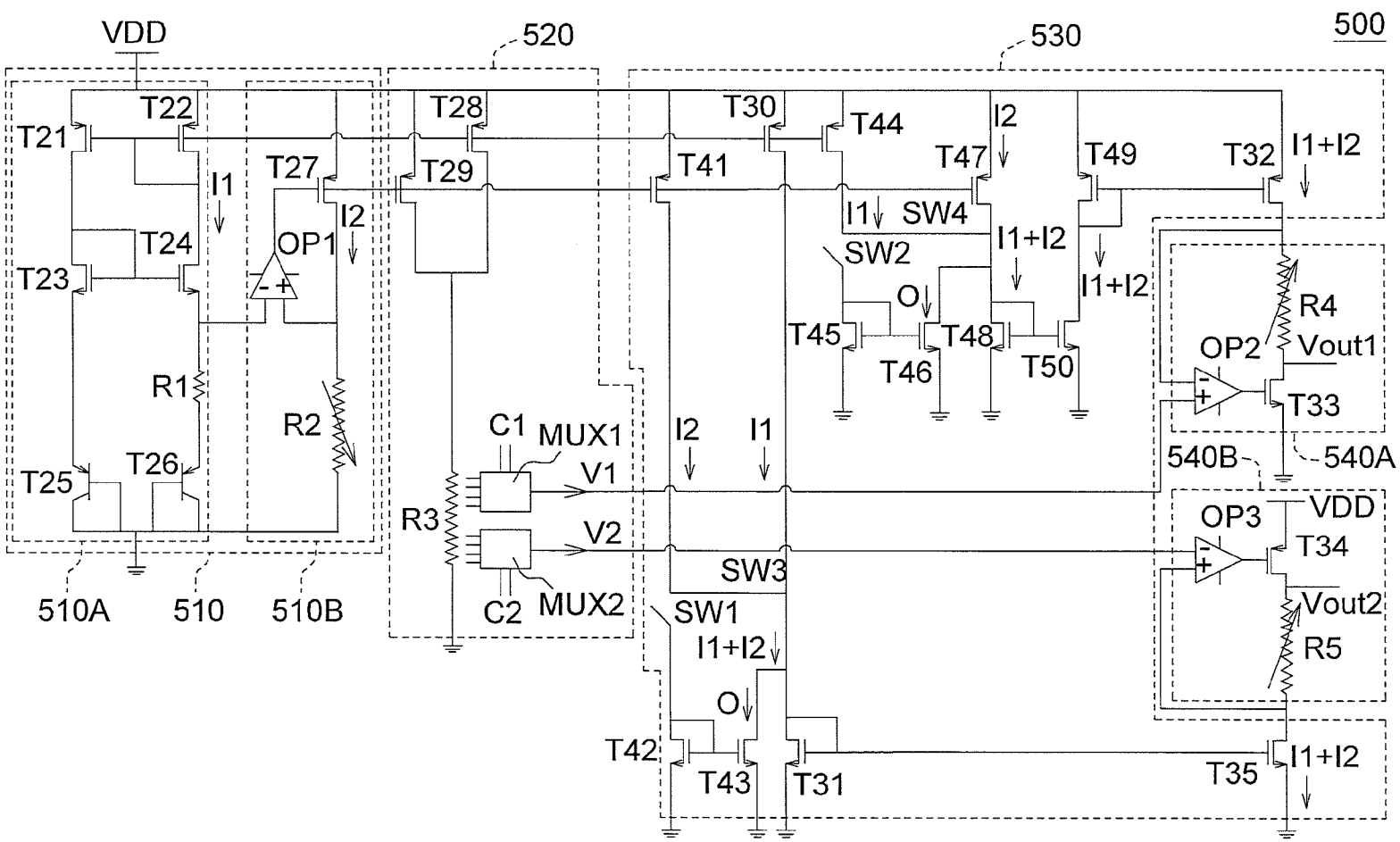

Referring to FIGS. 5A and 5B, which are schematic diagrams of a reference voltage generation circuit 500 according to a third embodiment of the disclosure are shown. Like the reference voltage generation circuit 400 of FIG. 4, the reference voltage generation circuit 500 of FIGS. 5A and 5B includes a bandgap reference circuit 510, a base voltage generation circuit 520, a bias current source circuit 530 and one or more regulating output circuits (exemplified by two regulating output circuits 540A and 540B). In the examples of FIGS. 5A and 5B, the bandgap reference circuit 510 further includes a PTAT current generation circuit 510A and a voltage-to-current conversion circuit 510B. The reference voltage generation circuit 500 of FIGS. 5A and 5B is different from the reference voltage generation circuit 400 of FIG. 4 in that the bias current source circuit 530 has a current path switching function so that the bias current may be flexibly switched between different temperature coefficients, and the output reference voltage of the regulating output circuits 540A and 540B may also be switched between different temperature coefficients. The differences between the reference voltage generation circuit 400 and the reference voltage generation circuit 500 are elaborated below, and the similarities disclosed in the first and the second embodiments are not repeated here.

To achieve the current path switching function, the bias current source circuit 530 includes switches SW1~SW4, having four implementations namely, implementation 1 (SW1 turned on, SW3 turned off; SW2 turned on, SW4 turned off), implementation 2 (SW1 turned on, SW3 turned off; SW2 turned off, SW4 turned on), implementation 3 (SW1 turned off, SW3 turned on; SW2 turned on, SW4 turned off), and implementation 4 (SW1 turned off, SW3 turned on; SW2 turned off, SW4 turned on). FIGS. 5A and 5B respectively show implementation 1 and implementation 4, and other implementations may be obtained by analogy. In practical applications, the switches SW1-SW4 may be operated in one or more implementations such as the implementations 1 and 4.

Referring to FIG. 5A. In implementation 1, the switches SW1 and SW2 are turned on, but the switches SW3 and SW4 are turned off. So the operation of the reference voltage generation circuit 500 is basically the same as the operation of the reference voltage generation circuit 400 of FIG. 4. That is, the bias currents I4 and I5 generated by the bias current source 530 have positive and negative temperature coefficients respectively, so the output reference voltages Vout1 and Vout2 of the regulating output circuits 540A and 540B are both positive-TC voltages.

Referring to FIG. 5B. In implementation 4, the switch SW2 is turned off, but the switch SW4 is turned on. So the current flowing through the mirror transistors T48 is I1+I2 and may have a zero temperature coefficient. By current mirroring of the mirror transistors T50, T49 and T32, the bias current I1+I2 is duplicated for provision to the regulating output circuit 540A. The switch SW1 is turned off but the switch SW3 is turned on. So the current flowing through the mirror transistors T31 is I1+I2 and may have a zero temperature coefficient. The mirror transistors T31 and T35 duplicate the bias current I1+I2 for provision to the regulating output circuits 540B.

To summarize, through switching of the switches SW1~SW4, the bias currents generated by the bias current source may be switched between different combinations of temperature coefficients. For example, in implementation 4, the bias currents all have zero temperature coefficients, and in implementation 1, the bias currents respectively have positive and negative temperature coefficients. Consequently, the temperature coefficients of the output reference voltage Vout1 and Vout2 may also be switched between different temperature coefficient combinations. Thus, the reference voltage generation circuit 500 may be used in the applications requiring switching between a non-zero temperature coefficient and a zero temperature coefficient, or may be used in the applications requiring both a non-zero temperature coefficient and a zero temperature coefficient.

Like FIG. 4, in other embodiments, different current mirroring paths may be designed to generate bias currents and output reference voltages with different temperature coefficients. For example, in implementation 1, the regulating output circuits 540A and 540B may receive the bias currents I4 and I5, so that the output reference voltages Vout1 and Vout2 may be negative-TC voltages. In other words, the output reference voltages Vout1 and Vout2 have various combinations of positive and/or negative temperature coefficients whose magnitudes may be adjusted through the variable resistors R4 and R5. Moreover, more or fewer bias currents and regulating output circuits may be implemented for providing more or fewer output reference voltages with identical or different temperature coefficients. Furthermore, the combined current and the base voltage generated by the base voltage generation circuit 520 are not limited to have zero temperature coefficients and may have non-zero temperature coefficients. Thus, the technologies disclosed above have flexible and wide application.

In the exemplary example of FIGS. 5A and 5B, the current combining function and the current path switching function under different implementations are exemplified by current subtraction and current summation. In other embodiments, the bias current source circuit 530 may implement other types of current combination and/or current path switching, such as the summing or subtracting the first and the second current I1 and I2 with different weights, to generate the output reference voltages with different temperature coefficients. Furthermore, given that the bandgap reference circuit 510 generates more initial currents, more types of current combination and current path switching on the initial currents may be implemented to generate output reference voltages with different temperature coefficients. The technology disclosed here may achieve wide and flexible applications.

The first to third embodiments disclosed may be selectively combined to form other possible embodiments. Exemplarily but not restrictively, in other possible embodiments, the bias current source circuit may include any combination of the bias current source circuits 230, 430 and 530 of FIGS. 2, 4, 5A and 5B, along with a corresponding total number of the regulating output circuits to generate various bias currents and output reference voltages.

Fourth Embodiment

Figure 6:
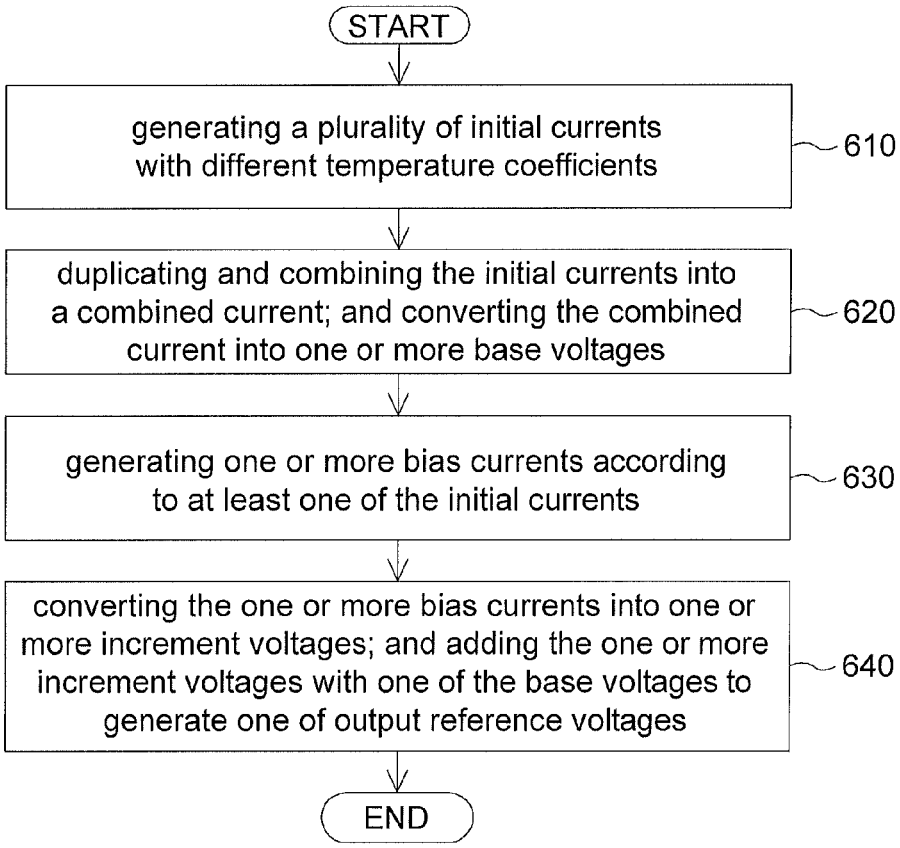
FIG. 6 shows a flowchart of a reference voltage generation method according to a fourth embodiment of the disclosure.

FIG. 6 shows a flowchart of a reference voltage generation method according to a fourth embodiment of the disclosure. As indicated in FIG. 6, in step 610, a plurality of initial currents with different temperature coefficients are generated, wherein the details of step 610 are similar to the generation of currents I1 and I2 by the bandgap reference circuit as disclosed in the first to third embodiments, and the similarities are not repeated here. In step 620, the initial currents are duplicated and combined into a combined current, and the combined current is converted into one or more base voltages, wherein the details of step 620 are similar to the generation of a base voltage with zero temperature coefficient by the base voltage generation circuit through the current mirroring and current conversion as disclosed in the first to third embodiments, and the similarities are not repeated here. In step 630, one or more bias currents are generated according to at least one of the initial currents, wherein the details of step 630 are similar to the details of current mirroring and duplication of one or more bias currents by the bias current source circuit as disclosed in the first to third embodiments, and the similarities are not repeated here. In step 640, the one or more bias currents are converted into one or more increment voltages, each of which is added to one of the base voltages to generate one of the output reference voltages, wherein the details of the step 640 are similar to the details of converting the base voltages and the bias currents into one or more output reference voltages with different temperature coefficients by the regulating output circuits as disclosed in the first to third embodiment, and the similarities are not repeated here.

Compared with the conventional art, the above embodiments extract the currents, rather than the voltages, from the bandgap reference circuit for subsequent processing, and there is no need to use many buffers. Therefore, the above embodiments of the disclosure have advantages such as small circuit area, low power consumption, simple structure, and accurate temperature coefficients. Besides, since the bias currents are combined through the current subtraction, the temperature coefficient of the bias currents may be increased. Accordingly, the required range of the output reference voltages may be achieved by using smaller variable resistor, and the range of the zero temperature coefficient base voltages may also be widened. Besides, by switching the current paths, the bias currents may be switched between different temperature coefficients, so the output reference voltages may be switched between different temperature coefficients, and hence suitable for various applications.

It will be appreciated by those skilled in the art that changes could be made to the disclosed embodiments described above without departing from the broad inventive concept thereof. It is understood, therefore, that the disclosed embodiments are not limited to the particular examples disclosed, but is intended to cover modifications within the spirit and scope of the disclosed embodiments as defined by the claims that follow.

What is claimed is:

1. A reference voltage generation circuit, comprising:

a bandgap reference circuit for generating a plurality of initial currents with different temperature coefficients;

a base voltage generation circuit coupled to the bandgap reference circuit for duplicating and combining the initial currents into a combined current, and for converting the combined current into one or more base voltages;

a bias current source circuit coupled to at least one of the bandgap reference circuit and the base voltage generation circuit for generating one or more bias currents according to at least one of the initial currents; and one or more regulating output circuits, each coupled to the base voltage generation circuit for receiving a corresponding one of the one or more base voltages, coupled to the bias current source circuit for receiving a corresponding one of the one or more bias currents, and converting the received bias current into a respective increment voltage and adding the increment voltage to the base voltage to generate a respective output reference voltage.

2. The reference voltage generation circuit according to claim 1, wherein the initial currents comprise a first current with a positive temperature coefficient and a second current with a negative temperature coefficient.

3. The reference voltage generation circuit according to claim 2, wherein the bandgap reference circuit comprises:

a proportional to absolute temperature (PTAT) current generation circuit for generating the first current; and a voltage-to-current conversion circuit coupled to a node of the PTAT current generation circuit for converting a voltage of the node into the second current.

4. The reference voltage generation circuit according to claim 1, wherein the bias current source circuit comprises one or more mirror transistors coupled to at least one of the bandgap reference circuit and the base voltage generation circuit for duplicating at least one of the initial currents as at least one of the one or more bias currents.

5. The reference voltage generation circuit according to claim 1, wherein the bias current source circuit comprises a current combination circuit coupled to at least one of the bandgap reference circuit and the base voltage generation circuit for duplicating and combining at least two of the initial currents into at least one of the one or more bias currents.

6. The reference voltage generation circuit according to claim 5, wherein the current combination circuit further comprises a plurality of switch elements switched on different current paths of the current combination circuit for combining different currents to switch a temperature coefficient of the bias current.

7. The reference voltage generation circuit according to claim 2, wherein each of the one or more bias currents generated by the bias current source circuit is equal to either of the first current, the second current, a sum of the first current and the second current, and a difference of the first current and the second current.

8. The reference voltage generation circuit according to claim 2, wherein the base voltage generation circuit adds the duplicated first current and the duplicated second current to generate the third current with a substantially zero temperature coefficient and converts the combined current into the one or more base voltages with a substantially zero temperature coefficient.

9. The reference voltage generation circuit according to claim 1, wherein the base voltage generation circuit comprises:

a mirror circuit comprising a plurality of parallel-connected mirror transistors, wherein a gate of each of the mirror transistor is coupled to the bandgap reference circuit for duplicating the initial currents and summing into the combined current; and a resistor element for converting the combined current into the one or more base voltages.

10. The reference voltage generation circuit according to claim 9, further comprising one or more multiplexer each coupled to the resistor element for selecting a resistance of the resistor element and adjusting one of the one or more base voltages.

11. The reference voltage generation circuit according to claim 1, wherein each of the one or more regulating output circuits comprises:

a resistor element coupled between the bias current source circuit and an output node;

an output transistor coupled to the output node; and an operational amplifier having a first input end coupled to one of the one or more base voltages of the base voltage generation circuit, a second input end coupled to the resistor element, and an output end coupled to a gate of the output transistor.

12. A reference voltage generation method, comprising:

generating a plurality of initial currents with different temperature coefficients;

duplicating and combining the initial currents into a combined current, and converting the combined current into one or more base voltages;

generating one or more bias currents according to at least one of the initial currents; and converting the one or more bias currents into one or more increment voltages and adding the one or more increment voltages to one of the base voltages to generate one of one or more output reference voltages.

13. The reference voltage generation method according to claim 12, wherein the initial currents comprises a first current with a positive temperature coefficient and a second current with a negative temperature coefficient.

14. The reference voltage generation method according to claim 13, wherein the step of generating the initial currents with different temperature coefficients comprises:

generating the first current; and converting a node voltage generated during the generation of the first current into the second current.

15. The reference voltage generation method according to claim 12, wherein the step of generating the one or more bias currents comprises duplicating at least one of the initial currents as at least one of the one or more bias currents.

16. The reference voltage generation method according to claim 12, wherein the step of generating the one or more bias currents comprises duplicating and combining at least two of the initial currents into at least one of the one or more bias currents.

17. The reference voltage generation method according to claim 16, wherein the step of combining the duplicated initial currents into one of the one or more bias currents comprises switching between different current paths to combine different currents and thereby switch a temperature coefficient of the bias current.

18. The reference voltage generation method according to claim 13, wherein each of the one or more bias currents is equal to either of the first current, the second current, a sum of the first current and the second current, and a difference of the first current and the second current.

19. The reference voltage generation method according to claim 13, wherein the step of generating the one or more base voltages comprises adding the duplicated first current and the duplicated second current to generate the third current with a substantially zero temperature coefficient and converting the combined current into the one or more base voltages with a substantially zero temperature coefficient.

20. The reference voltage generation method according to claim 12, wherein the step of generating the one or more base voltages comprises:

duplicating and summing the initial currents into the combined current; and converting the combined current into the one or more base voltages by a resistor characteristic.

21. The reference voltage generation method according to claim 20, wherein the step of converting the combined current into the one or more base voltages according to the resistor characteristic comprises performing one or more multiplexing processes for selecting a resistance value of the resistor characteristic to adjust the one or more base voltages.

* * * * *